US007212771B2

(12) United States Patent
Tanaka et al.

(10) Patent No.: US 7,212,771 B2
(45) Date of Patent: May 1, 2007

(54) GRID ELECTRODE, SCOROTRON CHARGER, AND IMAGE FORMING DEVICE

(75) Inventors: Mihoko Tanaka, Kanagawa (JP); Akihito Nishimura, Kanagawa (JP); Masaru Ishikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 96 days.

(21) Appl. No.: 11/117,691

(22) Filed: Apr. 29, 2005

(65) Prior Publication Data

US 2006/0002740 A1 Jan. 5, 2006

(30) Foreign Application Priority Data

Apr. 30, 2004 (JP) ..... 2004-136776
Apr. 15, 2005 (JP) ..... 2005-118757

(51) Int. Cl.
*G03G 15/02* (2006.01)

(52) U.S. Cl. ..... 399/171

(58) Field of Classification Search ..... 399/170, 399/171; 361/225, 229; 250/324, 325, 326; 347/123, 125, 151
See application file for complete search history.

(56) References Cited

U.S. PATENT DOCUMENTS 4,876,578 A * 10/1989 Hara et al. ..... 399/315
5,351,111 A * 9/1994 Takafuji et al. ..... 399/171
5,466,938 A * 11/1995 Nakayama et al. ..... 250/326
5,666,604 A * 9/1997 Nakagami et al. ..... 399/171

FOREIGN PATENT DOCUMENTS

JP 52109943 A * 9/1977
JP 62-181954 Y 11/1987
JP 3-42443 Y 9/1991
JP 05094076 A * 4/1993
JP 05181348 A * 7/1993
JP 08-036289 2/1996
JP 2001-13765 1/2001

* cited by examiner

*Primary Examiner*—Robert Beatty
(74) *Attorney, Agent, or Firm*—Morgan, Lewis & Bockius, LLP

(57) ABSTRACT

A grid electrode, disposed along a corotron wire, includes a planar, plate-shaped member having plural openings in each of which a longitudinal direction and a short side direction are formed, the longitudinal directions of the respective openings being lined up to be in a same direction, and connecting portions connecting openings adjacent to each other in a opening longitudinal direction and connecting portions connecting openings adjacent to each other in a opening short side direction. At each opening, a shortest distance from a center point to an opening edge is less than 1.5 mm, a grid opening ratio is greater than or equal to 82%, and a length of the longitudinal direction is at least 1.3 times a length of the short side direction. The connecting portions connecting openings adjacent to each other in the opening longitudinal direction are not disposed on a same line which is orthogonal to the corotron wire.

17 Claims, 10 Drawing Sheets

GRID ELECTRODE, SCOROTRON CHARGER, AND IMAGE FORMING DEVICE

CROSS-REFERENCE TO RELATED APPLICATION

This application claims priority under 35 USC 119 from Japanese Patent Application Nos. 2004-136776 and 2005-118757, the disclosures of which are incorporated by reference herein.

BACKGROUND OF THE INVENTION

1. Field of the Invention

The present invention relates to a grid electrode at which an opening pattern is formed, a scorotron charger, and an image forming device.

2. Description of the Related Art

A device utilizing corona discharge is generally used as a charger of an image forming device. Corotron chargers and scorotron chargers are known as corona discharge devices. In a corotron charger, a wire electrode spans the interior of a shield case, substantially parallel to a photosensitive body. High voltage is applied to the wire electrode such that corona discharge is caused, and charges are applied to the surface of the photosensitive body. A corotron charger has the drawback that it is easy for fluctuations to arise in the potential of the surface of the photosensitive body due to the accuracy of the charger, errors in setting, and the like. Scorotron chargers, which are advantageous in that they can charge to a uniform potential, have been used recently.

The main portion of a scorotron charger is structured by a discharge electrode which supplies charges to a photosensitive body and charges the photosensitive body, a grid electrode disposed between the discharge electrode and the photosensitive body and controlling the potential of the photosensitive body, and a shield case which is supported so as to cover the discharge electrode. An opening pattern is formed at the grid electrode in order to carry out potential control well. The charge potential of the surface of the photosensitive body can be controlled so as to be uniform by applying a high voltage to the discharge electrode and simultaneously applying the appropriate voltage (i.e., the voltage desired to be charged to) to the grid electrode (see, for example, Japanese Patent Applications Laid-Open (JP-A) Nos. 2001-13765 and 8-36289). Note that, in order to prevent white deletion or the like (there are also cases in which black stripes are generated) from arising in the image due to discharge products such as $O_3$, $N_{OX}$, and the like which are generated at the time of discharging, there are cases in which the grid electrode is subjected to a surface treatment such as painting or the like in order to decompose the discharge products.

In order to control the potential of the photosensitive body well, it is preferable to make the opening ratio along a straight line, which runs along the moving direction of the photosensitive body (hereinafter called "opening ratio on the line of movement of the photosensitive body"), uniform at all of the regions at which the opening pattern is formed. Here, "opening ratio on the line of movement of the photosensitive body" means the ratio of the distance which a given portion of the photosensitive body moves over while opposing the opening portions, among the distance that that given portion of the photosensitive body moves over while opposing the grid electrode. If the opening ratio on the line of movement of the photosensitive body differs greatly in accordance with the position of the aforementioned portion of the photosensitive body, it is easy for the discharge distribution to become non-uniform, which is not preferable. Such a phenomenon is particularly marked in cases in which the discharge electrode has deteriorated or the discharge electrode and the grid electrode have become dirty. Further, there is also the drawback that the costs required for maintenance of the charger are high due to deterioration of the discharge distribution. Note that, in cases in which there is dispersion in the opening ratio on the line of movement of the photosensitive body, generally, the average value of the opening ratio on the line of movement of the photosensitive body is defined as the opening ratio on the line of movement of the photosensitive body at the entire grid electrode.

As an example of aiming to make uniform the opening ratio on the line of movement of the photosensitive body, for example, JP-A No. 2001-13765 discloses a grid electrode 78 (see FIG. 9) in which this opening ratio is uniform and the ability to control the charge potential is excellent. Long, narrow openings 80, at which the positions of the end portions thereof are uniform, are formed in a fixed direction in the grid electrode 78.

However, in this grid electrode 78, because the long side connecting portions, which connect the long sides of the openings, are extremely long, there is the problem that it is easy for these long side connecting portions to deform. In particular, in a scorotron charger having a mechanism for cleaning the grid electrode 78, this problem arises markedly because, generally, the grid electrode is cleaned by a cleaning member being moved in a direction orthogonal to a moving direction X of the photosensitive body, in a state in which the cleaning member abuts the grid electrode 78. Further, when an opening corner portion 82 which is acute-angled is formed at an opening edge 81 forming the opening 80, there is the problem that the cleaning member (which is mainly bristles) is severed by the opening edge portion forming this acute-angled opening corner portion 82, and image defects arise. There is also the problem that the grid opening ratio cannot be made that large, and the controlling ability of the grid electrode 78 is insufficient.

In order to improve the mechanical strength of a grid electrode, it has been thought to use a grid electrode 88 such as shown in FIG. 10 and disclosed in Japanese Utility Model Application Publication (JP-Y) No. 3-042443. This grid electrode 88 is formed by a screen-like thin plate material having a larger number of minute openings 90 which are shaped as regular hexagons. Among the six sides of the openings 90, two sides are disposed so as to be oriented parallel to the moving direction X of the photosensitive body. In this way, because the configurations of the openings 90 of the grid electrode 88 are regular hexagons, small openings can be arranged densely.

However, the grid electrode 88 disclosed in JP-Y No. 3-042443 has the following problems. Two sides of the regular hexagonal opening 90 of the grid electrode 88 are disposed so as to be oriented parallel to the moving direction X of the photosensitive body, and strip-shaped portions 94, which are electrode portions between adjacent openings along the moving direction X of the photosensitive body, are lined up in one row at uniform intervals. On the other hand, the regions of the surface of the photosensitive body, which regions do not oppose the strip-shaped portions 94 (e.g., the regions of the photosensitive body surface opposing the regions 96 in FIG. 10A), are inclined at 30° or 150° with respect to the direction orthogonal to the rotating direction of the photosensitive body. Accordingly, with such an arrangement and configuration of openings 104, the dispersion in the opening ratio on the line of movement of the photosensitive body is large, and the controlling ability of the grid electrodes is poor (see FIGS. 10B and 10C).

In order to make the dispersion in the opening ratio on the line of movement of the photosensitive body smaller, there are methods such as making the widths of the strip-shaped portions 94 narrower so as to change the configurations and sizes of the openings 90, and the like. However, if the widths of the strip-shaped portions 94 are made narrow, the strength of the grid electrode deteriorates, and other problems arise, such as a predetermined controlling ability cannot be maintained when the openings 90 are made large, and the like.

Further, when the opening ratio on the line of movement of the photosensitive body is the same, the smaller the grid pitch, the better the ability to control the charge potential. (The grid pitch is the distance between both ends, in the moving direction X of the photosensitive body, at each opening portion, and is hereinafter abbreviated as "GP".) However, if the openings 90 are shaped as regular hexagons as described above, a problems arises in that, as compared with openings of the same opening ratio but other configurations, the GP is large, which is not very preferable in terms of the controlling ability (see FIGS. 10B and 10C).

In order to suppress the dispersion in the opening ratio on the line of movement of the photosensitive body, it has been thought to adjust the orientation of the regular hexagon shapes (see, for example, JP-Y No. 62-181954). However, as compared with openings of the same opening ratio but other shapes, an increase in the GP is unavoidable.

SUMMARY OF THE INVENTION

The present invention has been made in view of the above circumstances, and provides a grid electrode, a scorotron charger, and an image forming device.

A first aspect of the present invention is a grid electrode which is disposed along a corotron wire with a predetermined interval between the grid electrode and the corotron wire, including a planar, plate-shaped member having plural openings in each of which a longitudinal direction and a short side direction are formed, the longitudinal directions of the respective plural openings being lined up so as to be in a same direction, the plate-shaped member also having connecting portions connecting openings which are adjacent to each other in the opening longitudinal direction and connecting portions connecting openings which are adjacent to each other in the opening short side direction. At each opening, a shortest distance from a center point to an opening edge is S and S is less than 1.5 mm, a grid opening ratio is greater than or equal to 82%, and a length of the longitudinal direction of the opening is at least 1.3 times a length of the short side direction of the opening. The connecting portions connecting openings which are adjacent to each other in the opening longitudinal direction are not disposed on a same line which is orthogonal to the corotron wire.

The predetermined interval is set within a range such that the controllability of the charge potential at the time when the grid electrode is attached does not deteriorate.

A connecting portion allotted surface area, which is obtained by allotting, per opening, the surface area of the connecting portion connecting adjacent openings (e.g., forming the opening edge) at the discharge region, is determined. The grid opening ratio is the value obtained by dividing the surface area of one opening by the sum of the opening surface area and this connecting portion allotted surface area. In order to express this value in terms of percent, the value obtained by division is multiplied by 100.

Openings having two or more types of configurations may exist together as the openings.

In accordance with the first aspect of the present invention, by determining the opening short side direction by taking the moving direction of the photosensitive body into consideration, it is possible to obtain a grid electrode in which the opening ratio on the line of movement of the photosensitive body is uniform, without making the GP (grid pitch) large. Moreover, at each of the openings, the shortest distance from the center point to the opening edge is S, S is less than 1.5 mm, and the grid opening ratio is greater than or equal to 82%. Therefore, it is easy to realize a structure in which discharge that leads to a deterioration in image quality, such as bright spot discharge or the like, does not occur.

Moreover, the lengths in the longitudinal direction of the openings are at least 1.3 times the lengths in the short side direction of the openings. Therefore, it is easy to increase the mechanical strength of the grid electrode. Accordingly, the mechanical strength of the grid electrode can be improved without deteriorating the controlling ability of the grid electrode.

The grid electrode may be a grid electrode which is disposed along a corotron wire with a predetermined interval between the grid electrode and the corotron wire, and has, at a planar, plate-shaped member, plural openings which are lined-up in the same direction and whose long side lengths (lengths in a longitudinal direction of the openings) are a and short side lengths (lengths in a short side direction of the openings) are b, wherein, at each one opening of the plural openings, a long side connecting portion, which connects a long side of the one opening and long sides of two other openings which are adjacent to the one opening, and a short side connecting portion, which connects short sides of the two other openings, are connected at the substantial center of the long side of the one opening 30J, and the relationship $a \geqq 2b$ is established. In this case, the widths of the long side connecting portions and the short side connecting portions are set such that the needed opening ratio on the line of movement of the photosensitive body is obtained and the mechanical strength of the grid electrode does not become too weak.

In this way, it is possible to obtain a grid electrode in which the opening ratio on the line of movement of the photosensitive body is uniform, without making the GP (grid pitch) large. Further, because the plural openings are disposed in accordance with the long side connecting portions and the short side connecting portions, it is easy to increase the mechanical strength of the grid electrode. Accordingly, the mechanical strength of the grid electrode can be improved, without deteriorating the controlling ability of the grid electrode.

Because the present invention is structured as described above, it is possible to realize a grid electrode, a scorotron charger, and an image forming device in which the mechanical strength of the grid electrode is improved without a deterioration in the controlling ability of the grid electrode.

BRIEF DESCRIPTION OF THE DRAWINGS

Embodiments of the present invention will be described in detail based on the following figures, wherein.

DETAILED DESCRIPTION OF THE INVENTION

Figure 1:
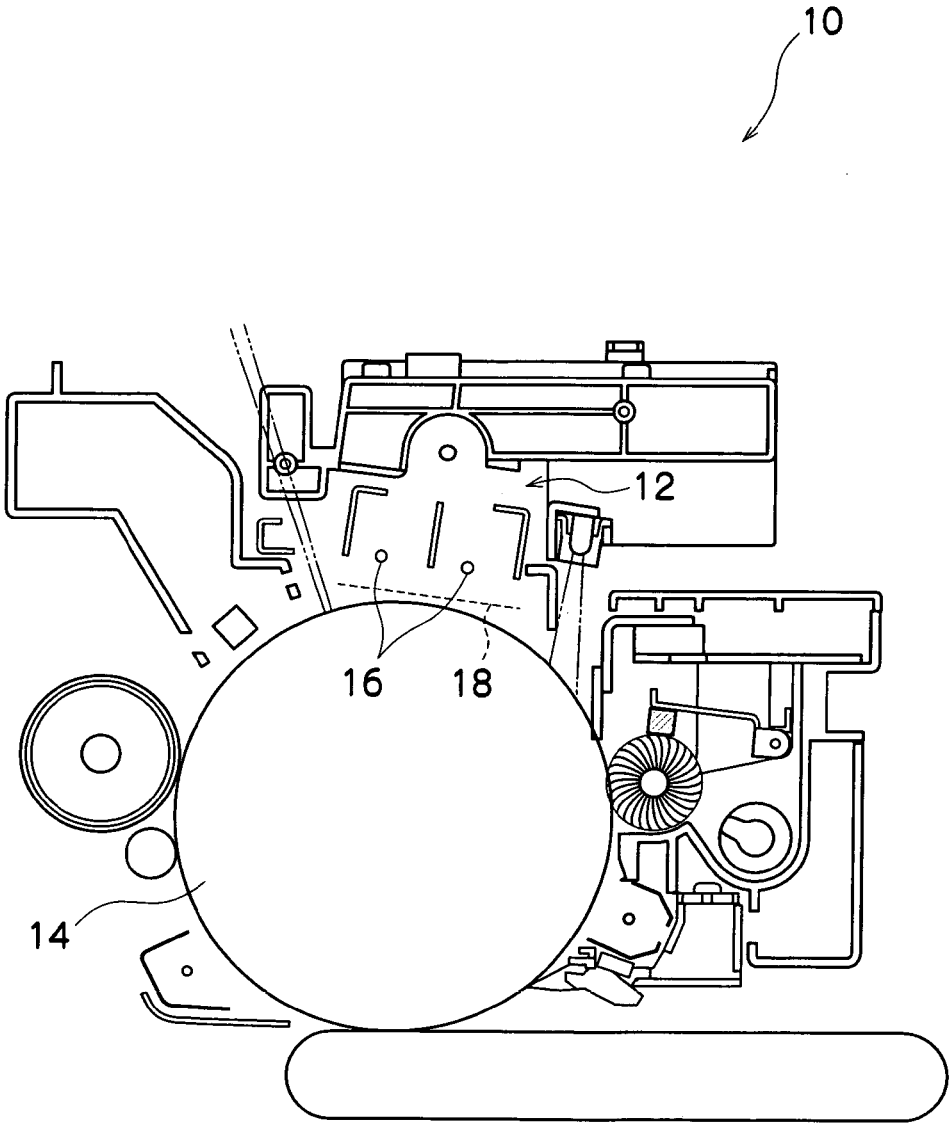
FIG. 1 is a side view showing the structure of an image forming device of a first embodiment.

Embodiments of the present invention will be described hereinafter. Note that, from the second embodiment on, portions which are similar to structural elements described thereinbefore are denoted by the same reference numerals, and description thereof is omitted.

[First Embodiment]

First, a first embodiment will be described. As shown in FIG. 1, an image forming device 10 relating to the present embodiment has, at the periphery of a drum-shaped photosensitive body 14, a scorotron charger 12 which relates to the present embodiment and which is replaceable.

Figure 2:
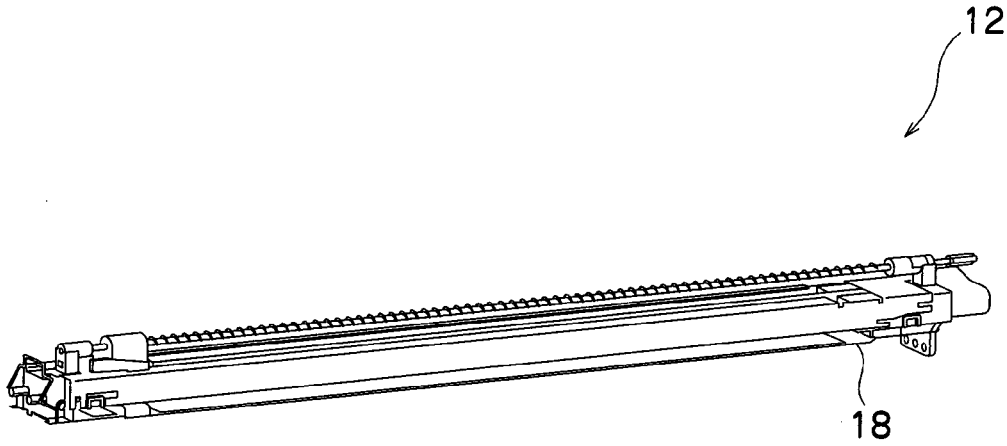
FIG. 2 is a perspective view of a scorotron charger used in the image forming device of the first embodiment.
Figure 3:
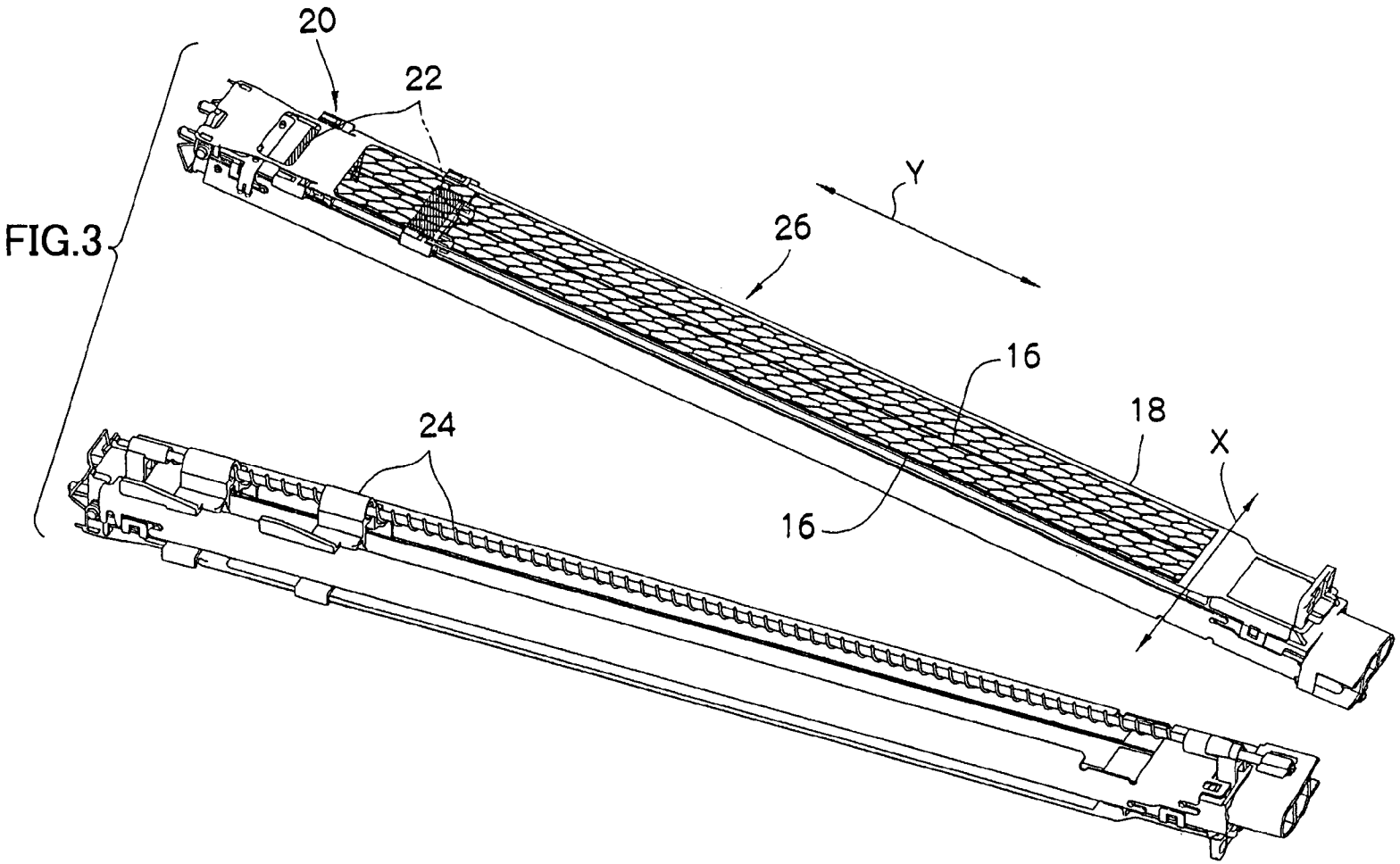
FIG. 3 is a perspective view of the scorotron charger used in the image forming device of the first embodiment.

As shown in FIGS. 2 and 3, the scorotron charger 12 is a long, narrow device which is provided along the direction of the rotational axis of the photosensitive body 14, and has two corotron wires 16, a grid electrode 18 relating to the present invention, and a cleaning mechanism 20. The grid electrode 18 is disposed so as to be positioned between the corotron wires 16 and the photosensitive body 14, and so as to be able to be replaced. The cleaning mechanism 20 moves in a direction orthogonal to the moving direction of the photosensitive body 14, and cleans the grid electrode 18. An electrode short side direction X of the scorotron charger 12 is a direction orthogonal to the corotron wires 16 and is oriented the same as the moving direction (the rotating direction) of the photosensitive body 14.

The cleaning mechanism 20 has a brush 22 and a moving mechanism 24. The brush 22 press-contacts the grid electrode 18 from the side at which the corotron wires 16 are disposed. The moving mechanism 24 slides the brush 22 along the rotational axis direction of the photosensitive body 14 (i.e., along an electrode longitudinal direction Y of the grid electrode) in a state in which the brush 22 press-contacts the grid electrode 18. The cleaning mechanism 20 cleans the grid electrode 18 due to the brush 22 sliding along the electrode longitudinal direction Y (the direction of the rotational axis of the photosensitive body 14) with respect to the grid electrode 18.

The grid electrode 18 is shaped so as to be long in the longitudinal direction of the scorotron charger 12. An opening pattern 26 is formed in the grid electrode 18 so that the grid electrode 18 is mesh-like.

Figure 4A:
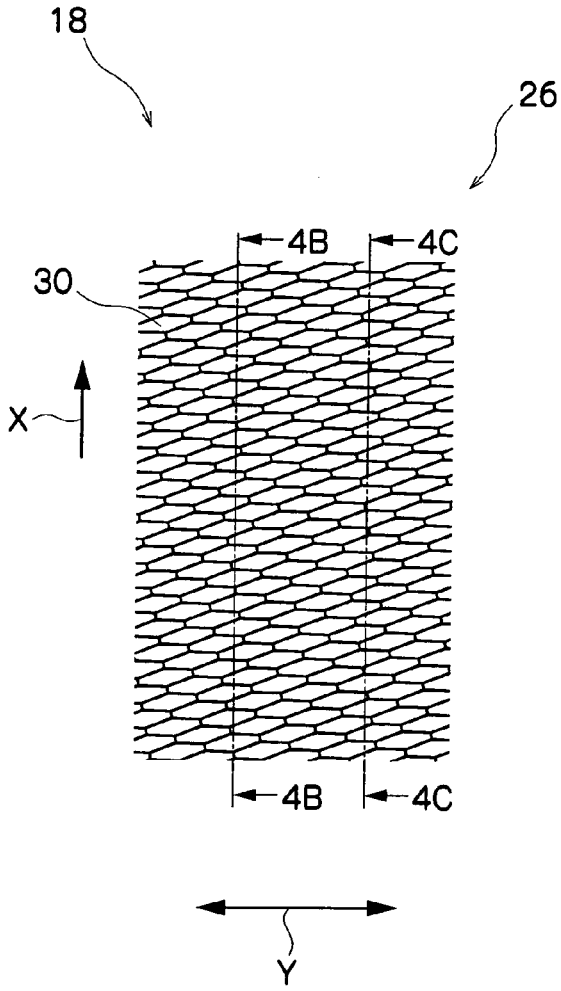
FIG. 4A is a partial plan view of a grid electrode attached to the scorotron charger used in the image forming device of the first embodiment.
Figure 4B:
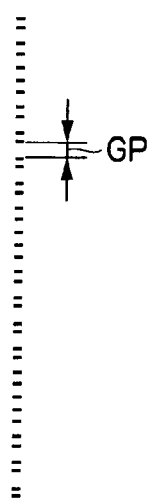
FIG. 4B is a sectional view taken along arrow 4B—4B of FIG. 4A.
Figure 4C:
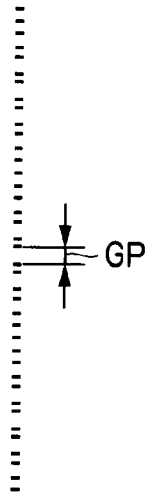
FIG. 4C is a sectional view taken along arrow 4C—4C of FIG. 4A.
Figure 5A:
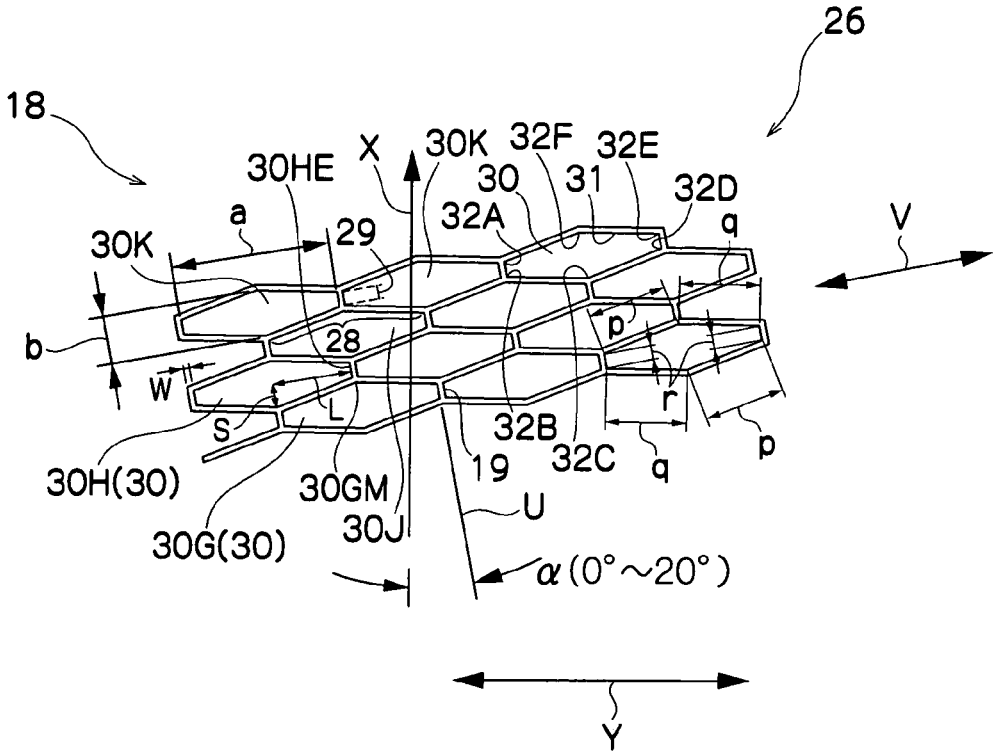
FIG. 5A is a partial enlarged view of FIG. 4A.

As shown in FIGS. 4 and 5A, each of respective openings 30 is shaped as a long, narrow hexagon, and is structured by three pairs of parallel sides. As shown in FIG. 5A, the lengths of the parallel sides are p, q, and r, respectively, and p and q are substantially the same and both are longer than r.

The openings 30 are disposed at the same orientation, so as to be staggered with respect to an opening short side direction U. In other words, openings which are adjacent to one another in the opening short side direction are disposed, along the opening longitudinal direction, such that the positions thereof are offset by a length which is substantially half of the opening longitudinal direction length. Namely, as seen from the opening short side direction U, a longitudinal direction end portion 30HE of an opening 30H, which is adjacent to an opening 30G, is positioned at a longitudinal direction substantially central portion 30GM of the opening 30G As seen from the opening short side direction U, the longitudinal direction end portions of the respective openings are positioned alternately.

Namely, along the corotron wires 16, the grid electrode 18 has, at a planar, plate-shaped member, plural openings 30 whose long side lengths (lengths in a longitudinal direction of the openings, that is, lengths along an opening longitudinal direction V) are a and short side lengths (lengths in a short side direction of the openings, that is, lengths along the opening short side direction U) are b, and which are lined up along the same direction. Further, a long side connecting portion (i.e., a long side connecting portion which connects openings which are adjacent to one another in the opening short side direction) 28, which connects a long side of one opening 30J structuring the plural openings 30 and the long sides two other openings 30K which are adjacent to the one opening 30J, and a short side connecting portion (i.e., a short side connecting portion which connects openings which are adjacent to one another in the opening longitudinal direction) 29, which connects the short sides of the two other openings 30K, are connected at the substantial center of the long side of the one opening 30J.

At each of the openings 30 forming the opening pattern 26, a shortest distance from a center point to an opening edge is S, and S is less than 1.5 mm. In the present embodiment, because the opening 30 is hexagonal as described above, the distance between opening edge portions 31*p*, which each form a side of length p and which oppose one another, is a value equal to 2×S. Note that the distance between opening edge portions 31*q*, which each form a side of length q and which oppose one another, also is a value equal to 2×S.

Figure 5B:
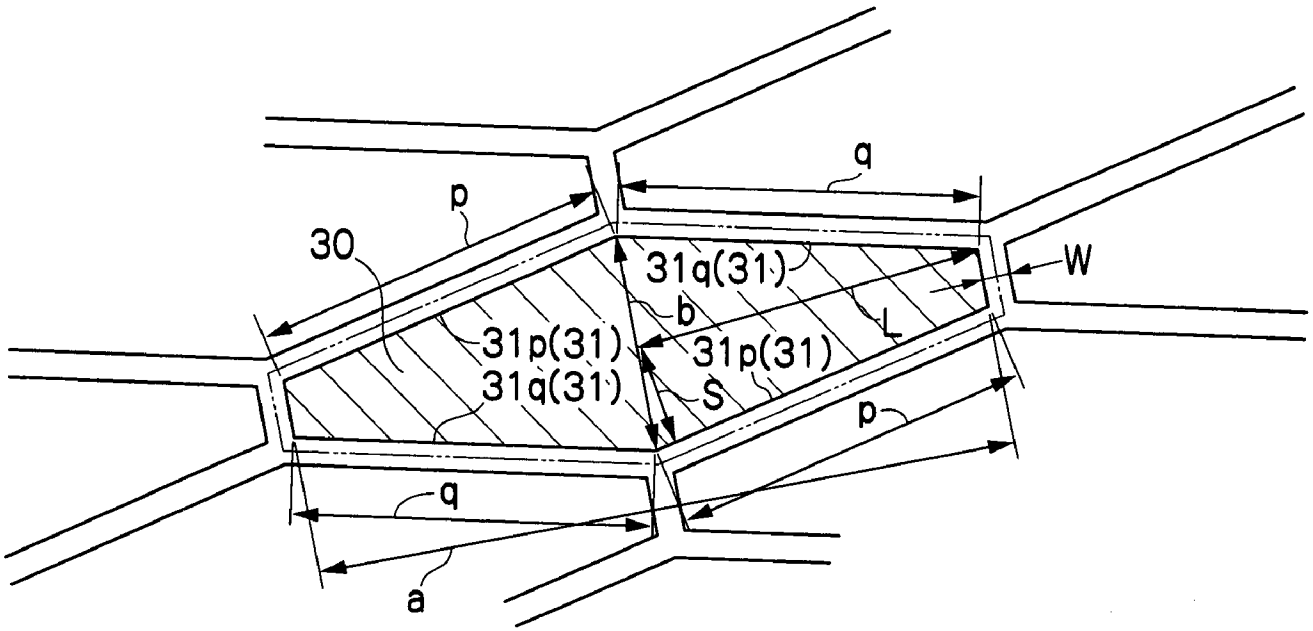
FIG. 5B is a partial enlarged view of FIG. 5A.

Further, in the present embodiment, because the opening 30 is the above-described hexagonal shape, in the discharge region, the sum of the opening surface area and the connecting portion allotted surface area, which is obtained by allotting, per opening, the surface area of the connecting portions connecting adjacent openings (e.g., forming the opening edge), is the surface area of the region within the two-dot chain line of FIG. 5B. A value, which is equal to the product obtained by multiplying by 100 the quotient obtained by dividing the opening surface area by the surface area of this region within the two-dot chain line, is the grid opening ratio as expressed in percent. In the present embodiment, the grid opening ratio is 82% or more.

An angle α, which is formed by the electrode short side direction (the moving direction of the photosensitive body 14) X and the opening short side direction U, is within the range of 0° to 20°, in consideration of the controllability of the charge potential.

Regarding the dimensions of the opening 30, the long side length a (length in the longitudinal direction of the opening) is made to be at least 1.3 times the short side length (length in the short side direction of the opening). Further, a longest distance L from the center point to the opening edge is determined so as to satisfy the relationship $L \geqq 2 \times S$.

The angles of opening corner portions 32A through 32F, which are formed by the opening edge 31, are all obtuse angles, and no acute-angled opening corner portions are formed.

As described above, the openings 30 are formed to be long and narrow, and are disposed at the same orientation so as to be in a staggered form with respect to the opening short side direction. Namely, openings which are adjacent to one another in the opening short side direction are disposed, along the opening longitudinal direction, such that the positions thereof are offset by a length which is substantially half of the longitudinal direction length of the opening, and the short side connecting portions 29 connecting openings which are adjacent to each other in the opening longitudinal direction V are not disposed on a same line which is orthogonal to the corotron wire 16. Further, the angle α, which is formed by the electrode short side direction (the moving direction of the photosensitive body 14) X and the opening short side direction U, is within the range of 0° to 20° in consideration of the controllability of the charge potential. Moreover, the grid opening ratio is 82% or more, the aforementioned shortest distance S is 1.5 mm or less, and a is made to be at least 1.3 times b. In addition, as shown in FIG. 4, the opening ratio on the line of movement of the photosensitive body in cross-section 4B—4B, and the opening ratio on the line of movement of the photosensitive body in cross-section 4C—4C are substantially the same. Still further, at the entire region where the opening pattern 26 is formed, the opening ratios on the line of movement of the photosensitive body at straight lines which run along the electrode short side direction (the moving direction of the photosensitive body 14) X are substantially the same, and there is markedly little dispersion in the opening ratio on the line of movement of the photosensitive body. Furthermore, the GP in cross-section 4B—4B (see FIG. 4B) along the moving direction of the photosensitive body 14 (i.e., the electrode short side direction), and the GP in cross-section 4C—4C (see FIG. 4C), are much smaller than the GP of the conventional grid electrode.

The controlling ability of the grid electrode 18 is therefore sufficiently high.

Because the openings 30 forming the opening pattern 26 are arranged in a staggered form, even if the width of the electrode member forming the openings 30 is not particularly small, the mechanical strength of the grid electrode 18 can be made to be sufficiently high.

The angles of the opening corner portions 32A through 32F formed by the opening edge 31 are all obtuse angles, and no opening corner portion which is an acute angle is formed. Therefore, when the brush 22 slides in order to clean, it is difficult for the bristles forming the brush 22 to be severed at the opening edge 31.

Further, in the present embodiment, the widths of the long side connecting portion 28 and the short side connecting portion 29 are both 0.2 mm or less, whereby a structure is obtained in which the grid opening ratio is unlikely to be reduced. Further, the plate thickness of the plate-shaped member forming the grid electrode 18 is in a range of 0.1 to 0.2 mm, whereby strength and flexure are preferable and whereby, moreover, stable etching can be carried out at the time of forming the opening pattern.

EXAMPLES

Grid electrodes are fabricated which are the grid electrode 18 described in the first embodiment, and at which the thickness t of the electrode member is a constant 0.1 mm, and (2×S) (i.e., twice the aforementioned S) and (2×L) (i.e., twice the aforementioned L) are changed as parameters. The respective values of t, 2×S, 2×L of each grid electrode are as shown in Tables 1 through 5. Note that, in the present Example, a width W of the electrode members which partition adjacent openings 30 (i.e., the width W of the long side connecting portion 28 and the short side connecting portion 29) is 0.1 which is the same as t.

TABLE 1

| | | | | | | |
|---|---|---|---|---|---|---|
| Dimension (t) | 0.1 | 0.1 | 0.1 | 0.1 | 0.1 | 0.1 |
| Dimension (2 × S) | 0.5 | 0.5 | 0.5 | 0.5 | 0.5 | 0.5 |
| Dimension (2 × L) | 1 | 1.5 | 2 | 2.5 | 3 | 3.5 |
| Opening ratio (%) of grid | 75.1 | 77.2 | 78.4 | 79.1 | 79.5 | 79.9 |
| Controlling ability of grid electrode (difference between Vg and Vh) | 135.0 | 110.0 | 100.0 | 90.0 | 88.0 | 85.0 |
| Evaluation of controlling ability of grid electrode (magnitude of effect of opening ratio) | X | X | X | X | X | X |
| Evaluation of non-actualization of wire bright spot discharge (magnitude of effect of S) | ○ | ○ | ○ | ○ | ○ | ○ |
| Overall evaluation | X | X | X | X | X | X |

TABLE 2

| | | | | | | |
|---|---|---|---|---|---|---|
| Dimension (t) | 0.1 | 0.1 | 0.1 | 0.1 | 0.1 | 0.1 |
| Dimension (2 × S) | 1 | 1 | 1 | 1 | 1 | 1 |
| Dimension (2 × L) | 1.5 | 2 | 2.5 | 3 | 3.5 | 4 |
| Opening ratio (%) of grid | 83.4 | 84.6 | 85.2 | 85.7 | 86.0 | 86.2 |
| Controlling ability of grid electrode (difference between Vg and Vh) | 58.0 | 50.0 | 44.0 | 42.0 | 38.0 | 35.0 |
| Evaluation of controlling ability of grid electrode (magnitude of effect of opening ratio) | Δ | ○ | ○ | ○ | ○ | ○ |
| Evaluation of non-actualization of wire bright spot discharge (magnitude of effect of S) | ○ | ○ | ○ | ○ | ○ | ○ |
| Overall evaluation | Δ | ○ | ○ | ○ | ○ | ○ |

TABLE 3

| | | | | | | |
|---|---|---|---|---|---|---|
| Dimension (t) | 0.1 | 0.1 | 0.1 | 0.1 | 0.1 | 0.1 |
| Dimension (2 × S) | 1.5 | 1.5 | 1.5 | 1.5 | 1.5 | 1.5 |
| Dimension (2 × L) | 2 | 2.5 | 3 | 3.5 | 4 | 4.5 |
| Opening ratio (%) of grid | 87.3 | 88.1 | 88.6 | 88.9 | 89.2 | 89.3 |

TABLE 3-continued

| | | | | | | |
|---|---|---|---|---|---|---|
| Controlling ability of grid electrode (difference between Vg and Vh) | 30.0 | 25.0 | 23.0 | 22.0 | 21.0 | 20.0 |
| Evaluation of controlling ability of grid electrode (magnitude of effect of opening ratio) | ○ | ○ | ○ | ○ | ○ | ○ |
| Evaluation of non-actualization of wire bright spot discharge (magnitude of effect of S) | ○ | ○ | ○ | ○ | ○ | ○ |
| Overall evaluation | ○ | ○ | ○ | ○ | ○ | ○ |

TABLE 4

| | | | | | | |
|---|---|---|---|---|---|---|
| Dimension (t) | 0.1 | 0.1 | 0.1 | 0.1 | 0.1 | 0.1 |
| Dimension (2 × S) | 2 | 2 | 2 | 2 | 2 | 2 |
| Dimension (2 × L) | 2.5 | 3 | 3.5 | 4 | 4.5 | 5 |
| Opening ratio (%) of grid | 89.7 | 90.3 | 90.7 | 90.9 | 91.1 | 91.3 |
| Controlling ability of grid electrode (difference between Vg and Vh) | 20.0 | 18.0 | 16.0 | 15.0 | 14.0 | 13.0 |
| Evaluation of controlling ability of grid electrode (magnitude of effect of opening ratio) | ○ | ○ | ○ | ○ | ○ | ○ |
| Evaluation of non-actualization of wire bright spot discharge (magnitude of effect of S) | Δ | Δ | Δ | Δ | Δ | Δ |
| Overall evaluation | Δ | Δ | Δ | Δ | Δ | Δ |

TABLE 5

| | | | | | | |
|---|---|---|---|---|---|---|
| Dimension (t) | 0.1 | 0.1 | 0.1 | 0.1 | 0.1 | 0.1 |
| Dimension (2 × S) | 3 | 3 | 3 | 3 | 3 | 3 |
| Dimension (2 × L) | 3.5 | 4 | 4.5 | 5 | 5.5 | 6 |
| Opening ratio (%) of grid | 92.4 | 92.7 | 93.0 | 93.1 | 93.2 | 93.3 |
| Controlling ability of grid electrode (difference between Vg and Vh) | 12.0 | 11.0 | 10.0 | 9.0 | 8.0 | 7.0 |
| Evaluation of controlling ability of grid electrode (magnitude of effect of opening ratio) | ○ | ○ | ○ | ○ | ○ | ○ |
| Evaluation of non-actualization of wire bright spot discharge (magnitude of effect of S) | X | X | X | X | X | X |
| Overall evaluation | X | X | X | X | X | X |

In each of Tables 1 through 5, (2×S) (i.e., twice the aforementioned S) is constant, and (2×L) (i.e., twice the aforementioned L) is changed as a parameter.

The grid opening ratio is determined by the values 2×S and 2×L. The grid opening ratios are also shown in Tables 1 through 5.

Moreover, the potential difference (Vg−Vh) between the potential (Vg) of the grid electrode upon discharging and the potential (Vh) of the drum-shaped photosensitive body 14 is determined in accordance with the grid opening ratio. If this potential difference is too large due to the grid opening ratio being too small, the controlling ability of the grid electrode is poor. In the present Example, the controlling ability of the grid electrode, which is determined by the potential difference, is evaluated, and the results of evaluation also are shown in Tables 1 through 5.

If the value of S is too large, bright spot discharge at the corotron wires 16 (wire bright spot discharge) occurs, and the image quality deteriorates. In the present Example, to what extent the wire bright spot discharge is suppressed (i.e., to what extent it does not actualize) is evaluated visually. These results of evaluation are also shown in Tables 1 through 5.

Moreover, an overall evaluation of (1) the controlling ability of the grid electrode based on the above-described potential difference, and (2) non-actualization of wire bright spot discharge are conducted. The results of the lower (inferior) one of above (1) and (2) are used as the results for the overall evaluation. These evaluation results also are shown in Tables 1 through 5.

As can be understood from Table 1, at a grid opening ratio of 79.9% or less, the potential difference (Vg−Vh) is greater than or equal to 85.0 V, and the controlling ability of the grid electrode is poor (an evaluation of "BAD" is given, the "BAD" is denoted by a cross in the Tables). As can be understood from Tables 2 through 5, when the grid opening ratio is greater than 79.9%, the potential difference is less than 85.0 V, and the deterioration in the controlling ability of the grid electrode is suppressed (evaluations of "NOT BAD", "GOOD", the "NOT BAD" and the "GOOD" are denoted, respectively, by a triangle and a circle in the Tables). Further, as can be understood from Table 2, when L is greater than or equal to twice the value of S (L≧2S) and the grid opening ratio is 84.6% or more, the potential difference is less than or equal to 50.0 V, and the controlling ability is markedly good (an evaluation of "GOOD").

As can be understood from Tables 3 through 5, even when L is not greater than or equal to twice the value of S, if the grid opening ratio is greater than or equal to 84.6%, the controlling ability of the grid electrode is markedly good. However, L being greater than S (e.g., 2S or more, and even 3S or more) made it easy to suppress the dispersion in the opening ratio on the line of movement of the photosensitive body along the moving direction X of the photosensitive body 14, and easy to make the grid opening ratio larger.

Further, as can be understood from Table 5, when 2×S is greater than or equal to 3 mm (i.e., when S is greater than or equal to 1.5 mm), wire bright spot discharge clearly is clearly actualized (an evaluation of "BAD"). As can be understood from Tables 1 through 4, when 2×S is smaller than 3 mm (i.e., when S is less than 1.5 mm), the actualization of wire bright spot discharge is suppressed (evaluations of "NOT BAD", "GOOD"). Further, when 2×S is 1.5 mm or less, wire bright spot discharge is sufficiently made to not actualize.

As described above, in the grid electrodes prescribed in Tables 1 through 5, the thickness t is 0.1 mm and the width W of the electrode members partitioning the adjacent openings 30 (i.e., the long side connecting portion 28 and the short side connecting portion 29) is 0.1 mm. Therefore, the strength of the grid electrode 18 is sufficient, and even if a cleaning member such as a brush or the like are to move in a state of abutting the grid electrode 18, the grid electrode 18 would not deform.

[Second Embodiment]

A second embodiment of the present invention will be described next.

As shown in FIGS. 4 and 5, in the present embodiment, each of the respective openings 30 forming the opening pattern 26 is shaped as a long, narrow hexagon, and is structured by three pairs of parallel sides. As shown in FIG. 5, the lengths of the parallel sides are p, q, and r, and p and q are substantially equal, which is the same as in the first embodiment. However, in the present embodiment, p, q, and r satisfy the relationships $p \geqq 3r$, $q \geqq 3r$.

Further, in the same way as in the first embodiment, the openings 30 are disposed at the same orientation, so as to be staggered with respect to the opening short side direction U. In other words, openings which are adjacent to one another in the opening short side direction are disposed, along the opening longitudinal direction, such that the positions thereof are offset by a length which is substantially half of the longitudinal direction length of the opening. Namely, as seen from the opening short side direction U, the longitudinal direction end portion 30HE of the opening 30H, which is adjacent to the opening 30G, is positioned at the longitudinal direction substantially central portion 30GM of the opening 30G. As seen from the opening short side direction U, the longitudinal direction end portions of the respective openings are positioned alternately.

In the present embodiment, a width b of the opening 30 along the opening short side direction U which is orthogonal to the opening longitudinal direction V, is less than or equal to 3 mm. Further, as shown in FIG. 4, the opening ratio on the line of movement of the photosensitive body in cross-section 4B—4B, and the opening ratio on the line of movement of the photosensitive body in cross-section 4C—4C, are substantially the same. Still further, at the entire region where the opening pattern 26 is formed, the opening ratios on the line of movement of the photosensitive body at straight lines which run along the electrode short side direction (the moving direction of the photosensitive body 14) X are substantially the same, and there is markedly little dispersion in the opening ratio on the line of movement of the photosensitive body. Furthermore, the GP in cross-section 4B—4B (see FIG. 4B) along the moving direction of the photosensitive body 14 (i.e., the electrode short side direction) X, and the GP in cross-section 4C—4C (see FIG. 4C), are much smaller than the GP of the conventional grid electrodes.

The controlling ability of the grid electrode 18 is thereby sufficiently high.

In the present embodiment, the grid opening ratio of the openings 30 can be calculated as follows by using a, b, and r.

A surface area N1 of the region within the opening 30 is calculated by the following formula.

$$N1=a\times(b+r)/2$$

N2, which is the sum (the surface area within the broken line shown in FIG. 5-2) of the opening surface area N1 and the connecting portion allotted surface area, which is obtained by allotting, per opening, the surface area of the connecting portion connecting adjacent openings (i.e., forming the opening edge), is similarly calculated.

Then, by determining $(N1/N2)\times 100$, the grid opening ratio as expressed in percent can be calculated.

Figure 6:
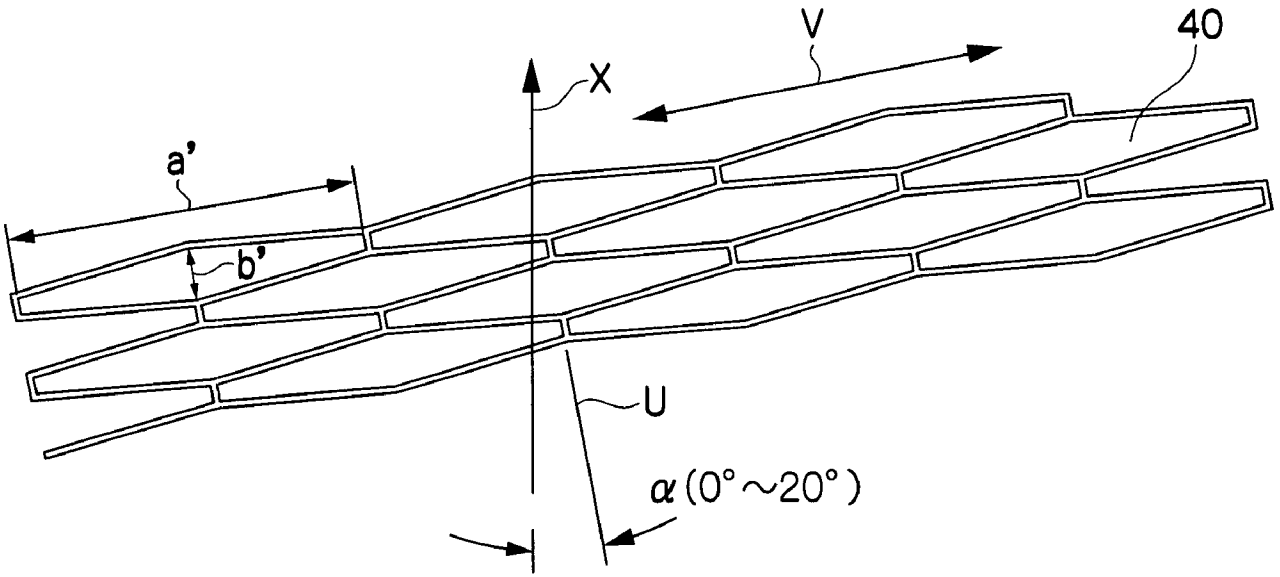
FIG. 6 is a partial enlarged plan view showing a modified example of a grid electrode in the first embodiment.

Further, it suffices to set the angle α, which is formed by the opening short side direction U and the electrode short side direction (the moving direction of the photosensitive body 14) X, such that, at all of the regions where the opening pattern 26 is formed, a straight line running along the electrode short side direction X successively passes over openings which are adjacent in the opening short side direction U, i.e., such that this straight line is not positioned on the both ends of a strip-shaped electrode portion (e.g., an electrode portion 19 shown in FIG. 5A) which forms the opening side of length r. In this way, the dispersion in the opening ratio on the line of movement of the photosensitive body can be reduced more. Further, the dispersion in the opening ratio on the line of movement of the photosensitive body can be suppressed even more by adjusting the difference in the lengths p and q. Moreover, as shown in FIG. 6, the openings may be made even longer and narrower, and a longitudinal direction length a' and a short side direction width b' of an opening 40 may satisfy the relationship $a' \geqq 3b'$. The controllability can thereby be further improved.

<Example of Second Embodiment>

In the present Example, the longitudinal direction length a of the opening 30 is 3.5 mm, the short side direction width b is 1.0 mm, α is 10°, the width W of the electrode members which partition the adjacent openings 30 (i.e., the long side connecting portion 28 and the short side connecting portion 29) is 0.1 mm, and the thickness of the electrode members is 0.1 mm. Further, in the present Example, r is 0.41 mm.

In accordance with the present Example, it is possible to easily realize a grid electrode which has a good controlling ability and sufficiently high mechanical strength.

[Third Embodiment]

Figure 7:
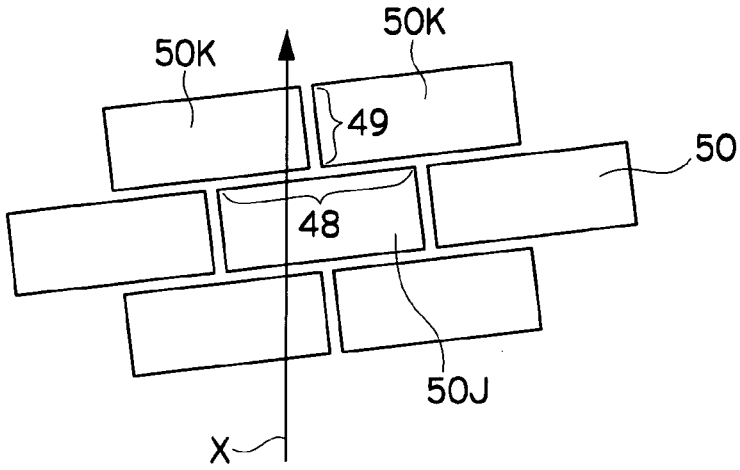
FIG. 7 is a partial enlarged plan view of a grid electrode of a second embodiment.

Next, a third embodiment will be described. In the third embodiment, the configurations of the openings formed at the grid electrode are different. Namely, as shown in FIG. 7, openings 50 which are formed at the grid electrode are formed as rectangles which are long and narrow in the electrode longitudinal direction.

In the present embodiment, in the same way as in the first embodiment, along the corotron wires, the grid electrode has, at a planar, plate-shaped member, the plural openings 50 whose long side lengths (lengths in the longitudinal direction of the openings) are a and short side lengths (lengths in the short side direction of the openings) are b, and which are lined up in the same direction. Further, a long side connecting portion 48, which connects a long side of one opening 50J structuring the plural openings 50 and the long sides of two other openings 50K which are adjacent to the one opening 50J, and a short side connecting portion 49, which connects the short sides of the two other openings 50K, are connected at the substantial center of the long side of the one opening 50J.

In this way, a grid electrode, in which the configurations of the openings are simpler than in the first embodiment, is realized.

[Fourth Embodiment]

Figure 8:
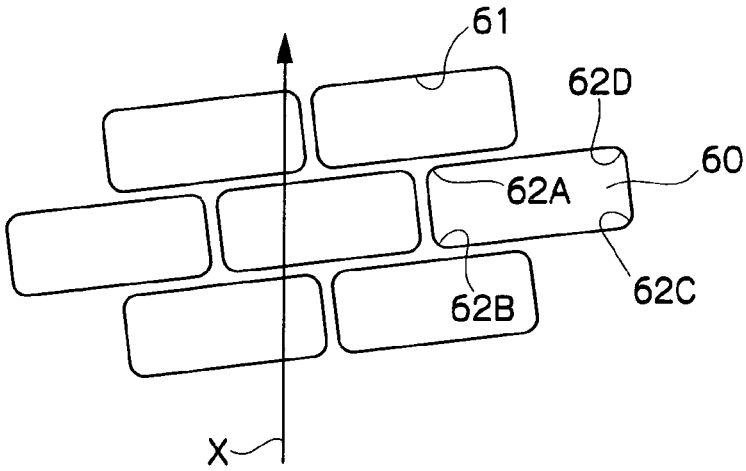
FIG. 8 is a partial enlarged plan view of a grid electrode of a third embodiment.
Figure 9A:
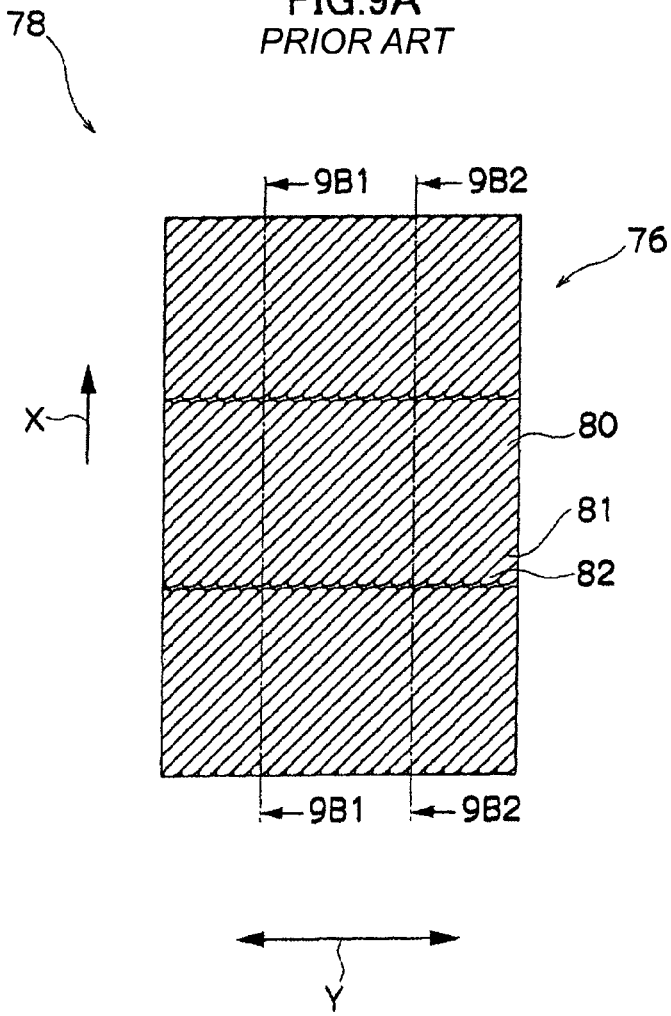
FIG.9A PRIOR ART
FIG. 9A is a partial plan view of a grid electrode attached to a conventional scorotron charger.
Figure 9B:
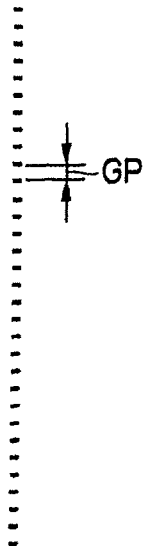
FIG.9B PRIOR ART
FIG. 9B is a sectional view taken along arrow 9B1—9B1 of FIG. 9A, and is the same as a sectional view taken along arrow 9B2—9B2 of FIG. 9A.
Figure 10A:
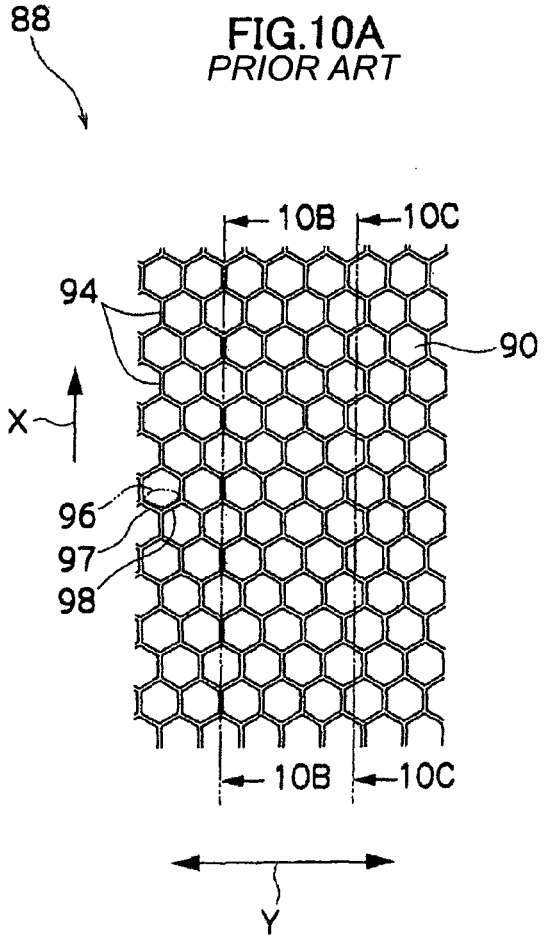
FIG.10A PRIOR ART
FIG. 10A is a partial plan view of a grid electrode attached to a conventional scorotron charger.
Figure 10B:
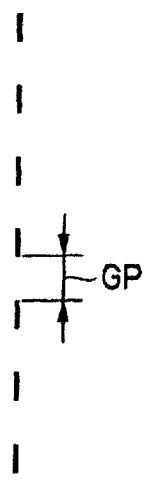
FIG.10B PRIOR ART
FIG. 10B is a sectional view taken along arrow 10B—10B of FIG. 10A.
Figure 10C:
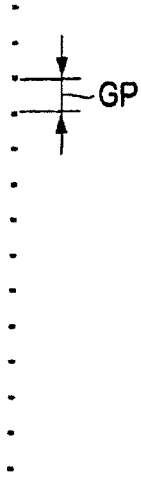
FIG.10C PRIOR ART
FIG. 10C is a sectional view taken along arrow 10C—10C of FIG. 10A.

A fourth embodiment will be described next. In the fourth embodiment, as shown in FIG. 8, four opening corner portions 62A through 62D of an opening 60 are formed to be arc-shaped, as compared with the third embodiment. In this way, marked effects can be seen in preventing the bristles of the brush 22 (see FIG. 3) from being severed by opening edges 61 of the openings 60 at the time of cleaning.

Although embodiments of the present invention have been described above, these embodiments are examples, and various modifications are possible within a scope which does not deviate from the gist of the present invention. Further, the scope of the right of the present invention is, of course, not limited to the above-described embodiments.

What is claimed is:

1. A grid electrode which is disposed along a corotron wire with a predetermined interval between the grid electrode and the corotron wire, comprising:

a planar, plate-shaped member having a plurality of openings in each of which a longitudinal direction and a short side direction are formed, the longitudinal directions of the respective plurality of openings being lined up so as to be in a same direction, the plate shaped member also having connecting portions connecting openings which are adjacent to each other in the opening longitudinal direction and connecting portions connecting openings which are adjacent to each other in the opening short side direction, wherein, at each opening, a shortest distance from a center point to an opening edge is S, and S is less than 1.5 mm, a grid opening ratio is greater than or equal to 82%, and a length of the longitudinal direction of the opening is at least 1.3 times a length of the short side direction of the opening, and wherein the connecting portions connecting openings which are adjacent to each other in the opening longitudinal direction are not disposed on a same line which is orthogonal to the corotron wire.

2. The grid electrode of claim 1, wherein, at each opening, a longest distance L from the center point to the opening edge satisfies a relationship $L \geqq 2 \times S$.

3. The grid electrode of claim 2, wherein L satisfies a relationship $L \geqq 3 \times S$.

4. The grid electrode of claim 1, wherein no acute-angled opening corner portion is formed at the opening edge.

5. The grid electrode of claim 4, wherein the opening edge is hexagonal.

6. The grid electrode of claim 4, wherein the opening edge is rectangular.

7. The grid electrode of claim 6, wherein the opening corner portions forming the opening edge are arc-shaped.

8. The grid electrode of claim 1, wherein widths of the connecting portions, which connect openings which are adjacent to one another in the opening short side direction, and the connecting portions, which connect openings which are adjacent to one another in the opening longitudinal direction, are both 0.2 mm or less, and a plate thickness of the plate-shaped member is in a range of 0.1 to 0.2 mm.

9. The grid electrode of claim 1, wherein, at the plurality of openings, an angle formed by the connecting portion, which connect openings which are adjacent to one another in the opening short side direction, and the corotron wire is set such that a straight line, which is orthogonal to the corotron wire, does not pass through all of the short side connecting portions.

10. The grid electrode of claim 1, wherein the short side direction of the openings is disposed, with respect to the photosensitive body, so as to form an angle of greater than or equal to 0° and less than or equal to 20° with a moving direction of the photosensitive body.

11. A scorotron charger comprising:

a charging unit that charges a photosensitive body; and a grid electrode disposed between the charging member and the photosensitive body, the grid electrode comprising:

a planar, plate-shaped member having a plurality of openings in each of which a longitudinal direction and a short side direction are formed, the longitudinal directions of the respective plurality of openings being lined up so as to be in a same direction, the plate-shaped member also having connecting portions connecting openings which are adjacent to each other in the opening longitudinal direction and connecting portions connecting openings which are adjacent to each other in the opening short side direction, wherein, at each opening, a shortest distance from a center point to an opening edge is S, and S is less than 1.5 mm, and grid opening ratio is greater than or equal to 82%, a length of the longitudinal direction of the opening is at least 1.3 times a length of the short side direction of the opening, and wherein the connecting portions connecting openings which are adjacent to each other in the opening longitudinal direction are not disposed on a same line which is orthogonal to the corotron wire.

12. The scorotron charger of claim 11, wherein the grid electrode is replaceable.

13. The scorotron charger of claim 11, further comprising a cleaning unit that cleans the grid electrode.

14. The scorotron charger of claim 13, wherein the cleaning unit has:

a cleaning member abutting the grid electrode; and a moving mechanism moving the cleaning member in a direction orthogonal to a moving direction of the photosensitive body, in a state in which the cleaning member abuts the grid electrode.

15. The scorotron charger of claim 14, wherein the cleaning member is a brush.

16. An image forming device comprising a scorotron charger, the scorotron charger comprising:

a charging unit that charges a photosensitive body; and a grid electrode disposed between the charging member and the photosensitive body, the grid electrode comprising:

a planar, plate-shaped member having a plurality of openings in each of which a longitudinal direction and a short side direction are formed, the longitudinal directions of the respective plurality of openings being lined up so as to be in a same direction, the plate-shaped member also having connecting portions connecting openings which are adjacent to each other in a opening longitudinal direction and connecting portions connecting openings which are adjacent to each other in a opening short side direction, wherein, at each opening, a shortest distance from a center point to an opening edge is S, and S is less than 1.5 mm, a grid opening ratio is greater than or equal to 82%, and a length of the longitudinal direction of the opening is at least 1.3 times a length of the short side direction of the opening, and wherein the connecting portions connecting openings which are adjacent to each other in the opening longitudinal direction are not disposed on a same line which is orthogonal to the corotron wire.

17. The image forming device of claim 16, wherein the scorotron charger is replaceable.

* * * * *